US005688011A

United States Patent [19]

Gulley

[11] Patent Number: 5,688,011

[45] Date of Patent: Nov. 18, 1997

[54] LIFTING SLING SYSTEM HAVING SINGLE STRAP WITH SIZE-VARYING, SPACED, IN-LINE EYE LOOPS

[75] Inventor: William F. Gulley, Monroe, La.

[73] Assignee: Kenneth W. Browder, W. Monore, La.; a part interest

[21] Appl. No.: 497,548

[22] Filed: Jun. 30, 1995

[51] Int. Cl.[6] ..... B66C 1/12

[52] U.S. Cl. ..... 294/74

[58] Field of Search ..... 294/74, 82.14, 294/149, 152, 156; 224/103; 59/79.1, 93

[56] References Cited

U.S. PATENT DOCUMENTS

| | | | |
|---|---|---|---|
| 1,548,190 | 8/1925 | Cronqvist | 294/82.14 |
| 2,357,182 | 8/1944 | Farmer | 294/74 |
| 2,508,795 | 5/1950 | Nielson | 294/152 |
| 3,701,559 | 10/1972 | Marino et al. | 294/74 |
| 4,431,226 | 2/1984 | Weilert | 294/152 |
| 4,441,748 | 4/1984 | St. Germain | 294/74 |
| 4,737,069 | 4/1988 | Coblentz | 294/74 |
| 4,993,769 | 2/1991 | Chapalain | 294/74 |
| 5,308,101 | 5/1994 | Monty | 280/480.1 |

FOREIGN PATENT DOCUMENTS

| | | | |
|---|---|---|---|
| 1516-445 | 10/1989 | U.S.S.R. | 294/74 |
| 952210 | 3/1964 | United Kingdom | 294/74 |

*Primary Examiner*—Dean Kramer
*Attorney, Agent, or Firm*—C. Emmett Pugh; Pugh/Associates

[57] ABSTRACT

A sling for lifting a heavy work piece (e.g. a pipe section) including a strap of flexible, fabric-like material having first and second, looped strap ends, and first, outer & second, inner strap surfaces. The first, outer strap surface has a plurality of eye-loops also of flexible, fabric-like material affixed thereto and spaced along the length thereof. The first, looped, strap end is selectively attachable to one of the plurality of eye-loops to form a closed lifting loop. The strap preferably is made of a fabric material of Nylon™. The eye-loops are preferably constructed of the same material as the strap, and are preferably attached to the strap by stitching. Each eye-loop is preferably separated from the first strap end by a distance sufficient to allow each eye-loop to be used in conjunction with the first strap end to form a snug fit about a different, standard-size pipe. An attachment device (e.g. a shackle) is included for selectively attaching the first strap end to an appropriately selected one of the plurality of eye-loops. The second, opposite, looped end, as well as the other spaced, eye-loops, are used, when needed, for attachment or rigging points for, for example, crane hooks, chain hooks, etc. Exemplary riggings techniques are illustrated in FIGS. 6, 8 & 9. Two exemplary embodiments for the sling strap of the system are illustrated in FIGS. 1 & 2 and 6, respectively.

28 Claims, 6 Drawing Sheets

LIFTING SLING SYSTEM HAVING SINGLE STRAP WITH SIZE-VARYING, SPACED, IN-LINE EYE LOOPS

TECHNICAL FIELD

The present invention relates to slings for holding, lifting or otherwise manipulating a heavy load or other heavy object, and in particular to slings constructed of fabric (e.g. nylon) strapping material having a plurality of spaced eye-loops used in connection with, for example, one or more connecting shackles or other means of fastening, for use with loads of various sizes. An exemplary pipe load with which the invention is used typically weighs, for example, hundreds of pounds.

BACKGROUND ART

A list of prior patents which may be of interest is provided below:

| Patent No. | Inventor | Issue Date |
|---|---|---|
| 3,592,502 | Bolliger | 07/13/69 |
| 3,611,709 | Bilbey | 10/12/71 |
| 3,840,262 | Foster et al | 10/08/74 |
| 4,239,271 | Beasley et al | 12/16/80 |
| 4,834,439 | van de Kamp | 05/30/89 |
| 4,856,836 | Delphin | 08/15/89 |
| 2,583,030 (FR) | Baroux | 12/12/86 |

In the "sling" art is known to use a strap of woven or flexible material with loops formed at the terminal ends of the strap; note, for example, the U.S. Pat. No. 3,592,502 to Bolliger of Sweden issued in 1971, and the U.S. Pat. No. 4,239,271 to Beasley et al issued in 1980.

The van de Kamp patent (U.S. Pat. No. 4,834,439) teaches the use of a closed sling of textile webbing material for load lifting which includes four "lifting loops" formed by four slots at greatly spaced locations along of its length, with the closed length webbing material forming four lobes somewhat similar to a four leaf clover. The "lifting loops" are located at the four corners of the cloverleaf lobes into which loops four, converging crane hooks are placed to lift a rectangular, box-like, stacked load carried by the sling. The inner sides of the loops are engaged by oppositely directed, diagonally disposed, tie loops. Although pertinent to the invention, the "loops" and sling of van de Kamp are quite different in structure and use from the strap of the present invention.

The French patent document 2,583,030 of Baroux (1980) is directed to a sling for handling a bundle having a continuous, closed member having a supplemental "clamping strap" which is tied across to a loop to enclose the bundle for lifting. There is thus only a single loop along the length of the closed member and the effective diameter is determined by how much of the "clamping strap" is left untied to the loop. This approach likewise is substantially different in structure and use from the present invention.

The nylon sling assembly of Joseph Delphin disclosed in the U.S. Pat. No. 4,856,836 uses two straps, each with a variable diameter, end loop, to engage rounded or cylindrical objects useful in the off-loading of cargo to and from an offshore well platform. The loops include above them choker sleeves which slide up and down on the straps to open and close effective diameters of the loops.

The Foster et al patent (U.S. Pat. No. 3,840,262) is directed to a pipe sling having spaced end members with fabric belting material wrapped back and forth between the end members.

The patent to Bilbey (U.S. Pat. No. 3,611,709) issued in 1971 shows the use of the links of the chain as a connecting area for a hook or other type connector.

A problem with currently available lifting straps is the inability of these straps to snugly fit about a work piece without applying a crushing force to the work piece. As will be seen more fully below, the present invention is substantially different in structure, methodology and approach from that of the prior art slings.

GENERAL SUMMARY DISCUSSION OF INVENTION

The sling system of the invention is designed to be used, for example, in existing areas where head room and material to rig from is a problem, particularly for use with very heavy loads, such as, for example, heavy pipe. An exemplary pipe load with which the invention can be used typically weights, for example, hundreds of pounds.

The sling system of the invention is also designed to eliminate the need for several slings when, for example, catching and drifting loads into position. The sling system of the invention is thus designed to give maximum head room in areas where, for example, inches could determine whether or not a load can be put into position.

In using the sling system of the present invention, one does not need several slings to lift and drift the load into position, as is commonly the case in the prior art approaches in actual use in the field. The invention allows the load to be kept in control at all times. Additionally, there is no chance of a load to slip during the typical changing of the rigging several times using the approaches of the prior art in use in the field. Also, there is less chance of a worker to use a chain to lift or drift a load, which is a major safety problem on construction projects.

The sling of the invention is preferably made of nylon strap material or other appropriate, flexible, fabric-type material and has a series of spaced eye-loops located in spaced positions to fit, for example, all pipe circumferences desired, with standard sizes made for "off-the-shelf" availability.

The sling system of the present invention eliminates the need for, for example, temporary steel and lifting lugs in a lot of problem areas, especially where "hot work permits" are required. The invention also saves on man-hours and materials that otherwise would be required in the actual prior art systems in use in the field.

The sling system of the present invention is, it is believed, the safest sling to use when catching loads and drifting loads, as the sling will have the weight of the load at all times. No matter how many chain falls are used, the load will be in control at all times, because the user never has to change slings, as in the prior art, but only change the rigging points on the sling of the present invention.

The sling system of the present invention can be designed to fit any rigging need. The weight and type of load will determine the specifics of the sling, with many situations calling for standard sized slings. The tail length, that is, the length from the last eye-loop to the end of the sling can be changed to a longer length to drop the load(s) to any elevation(s) required, or, alternatively, a standard size sling can be used and appropriately shackled.

It is thus a basic object of the present invention to provide a flexible, fabric sling which can be readily used with many, different sized, heavy loads or pipe circumferences, which is very safe and can be used in close-quarters type situations.

It is also an object of the invention to provide a strap for lifting a work piece which is adjustable to fit about a variety of different sized work pieces.

It is a further object of the invention to provide a strap for lifting a work piece that includes a plurality of loops along its length which are connectable to snugly fit about a variety of different sized work pieces.

It is a still further an object of the invention to provide a method for lifting a work piece in conjunction with a strap lift or sling with a spaced series of eye-loops.

Accordingly, a sling for lifting a work piece is provided. The sling comprises a strap having a first strap end, a second strap end, a first, exterior strap surface, and a second, inner side or interior strap surface.

The first strap surface has a plurality of eye-loops connected thereto and spaced along the length thereof. The first strap end is selectively attachable to one of the plurality of eye-loops in a manner to form a closed lifting loop.

The strap preferably is of a fabric material, preferably one made of nylon fibers. The eye-loops are preferably constructed of the same material as the strap, and preferably are connected or attached to the strap by appropriate stitching. Each eye-loop is preferably separated from the first strap end by a distance sufficient to allow each eye-loop to be used in conjunction with the first strap end to form a snug fit about, for example, a different, standard-size pipe. The strap may be formed from one or more layers of woven strapping material.

In a preferred embodiment, the sling further includes an attachment device for selectively attaching the first strap end to one of the plurality of eye-loops. The attachment device has a first portion disposed through one of the plurality of eye-loops when the first strap end is attached to one of the plurality of eye-loops.

Any attachment device which will provide a connection, between, for example, the first strap end and an eye-loop of sufficient strength to lift the desired work piece is sufficient to practice some of the broader aspects of the invention. Examples of suitable attachament devices would include hooks, safety hooks, snap hooks and shackles.

The first strap end preferably terminates in a first end-loop, and the attachment device preferably further includes a second portion that is disposed through the first end-loop when the first strap end is attached to one of the plurality of eye-loops.

Each of the plurality of eye-loops is preferably spaced a different predetermined distance from the first strap end in a manner such that the sling may be placed snugly above a variety of different sized work pieces when the first strap end is attached to a selected one of the plurality of eye-loops.

When this configuration is used, the first strap end preferably terminates in a first end-loop, and the attachment device preferably further includes a second portion that is disposed through the first end-loop when the first strap end is attached to the one of the plurality of eye-loops. It is more preferred that a second plurality of the plurality of eye-loops have an effective distance within, for example, about one (~1") inch of the following values: nineteen and seven-eighths, twenty-six, thirty-two and three-fourths, thirty-nine, forty-two and seven-eights, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eights inches. The term "effective-distance" is used herein to mean the farthest distance between the point of connection on the first strap end and the farthest interior portion of an eye-loop. The effective distance of each eye-loop of the second plurality is different from the effective distance of every other eye-loop of the second plurality.

In another aspect of the invention a sling for lifting a work piece comprising a strap having a first strap end terminating in a first end-loop, a first strap surface, and a second strap surface is provided. The first strap surface has in connection therewith a plurality of eye-loops spaced along the length thereof. The first end-loop is selectively and individually attachable to each of the eye-loops with a shackle.

Each of the eye-loops is preferably spaced a predetermined distance from the first end-loop in a manner such that the sling may be placed snugly about a variety of different sized work pieces. It is also preferred to include a shackle with the sling. The shackle includes a shackle bar having a first and second shackle-end, bent to form a central opening accessible through a throat opening; and a shackle pin. Each of the first and second shackle-ends has an aperture there through of a size sufficient to receive therein a portion of the shackle pin. The throat opening is of a size sufficient to allow a section of the strap to pass there through into the central opening.

Each of the eye-loops is spaced a predetermined distance from the first strap end in a manner such that the sling may be placed snugly about a variety of work pieces. A second plurality of the plurality of eye-loops preferably have an effective distance within one inch of the following values; nineteen and seven-eighths, twenty-six, thirty-two and three-fourths, thirty-nine, forty-two and seven-eighths, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eighths inches. The effective distance of each eye-loop of the second plurality is different from the effective distance of every other eye-loop of the second plurality.

It is alternatively preferred that each of the eye-loops is in connection with the first strap surface along a length of the first strap surface between about one and six (~1–6") inches long.

In a still further aspect of the invention, a method of lifting a work piece is provided. The method comprises the following steps—(a) providing a sling comprising a strap having a first strap end, a second strap end, a first strap surface, and a second strap surface; the first strap surface having in connection therewith a plurality or series of eye-loops spaced along the length thereof; and an attachment device for selectively attaching the first strap end to one of the eye-loops, the attachment device having a first portion disposed through one of the eye-loops when the first strap end is attached to one of the eye-loops; (b) wrapping the first strap end about the work piece in a manner such that the second, interior side, strap surface is in contact with the work piece; (c) attaching the first strap end to one of the eye-loops with the attachment device; and (d) exerting a force on the strap sufficient to lift the work piece.

The sling provided preferably has a number of the eye-loops each spaced a predetermined distance from the first strap end in a manner such that the sling may be placed snugly about a variety of different sized work pieces; and more preferably has a second plurality of the plurality of eye-loops having an effective distance preferably within about one (~1") inch of the following values: nineteen and seven-eighths, twenty-six, thirty-two and three-fourths, thirty-nine, forty-two and seven-eighths, forty-nine and one-fourth, fifty-five and one-half, sixty-one and seven-eights, sixty-eight, seventy-four and three-eighths, ninety-three and one-fourth, one-hundred-twelve, and one-hundred-thirty and seven-eighths inches, respectively. The effective distance of each eye-loop of the second plurality preferably is different from the effective distance of every other eye-loop of the second plurality.

In a preferred method the first strap end of the sling terminates in a first end-loop, and the attachment device further includes a second portion that is disposed through the first end-loop when the first strap end is attached to one of the eye-loops.

In another preferred method, the attachment device is a shackle. The shackle includes a shackle bar, having first and second shackle-ends, bent to form a central opening accessible through a throat opening, and a shackle pin. Each of the first and second shackle-ends has an aperture there through of a size sufficient to receive therein a portion of the shackle pin. The throat opening is of a size sufficient to allow a section of the strap to pass therethrough into the central opening.

In this method, the step of attaching the first strap end to one of the eye-loops includes the steps of: (i) placing the first end-loop about the shackle bar in a manner such that a portion of the first end-loop is disposed within the central opening; (ii) positioning one of the eye-loops in a manner such that an interior opening of the eye-loop is positioned between the apertures of the first and second shackle-ends of the shackle bar; and (iii) inserting the shackle pin through the apertures of the first and second shackle-ends while the interior opening of the eye-loop is positioned there between.

It is thus preferred to provide a sling wherein a number of the eye-loops are each spaced a predetermined distance from the first strap end in a manner such that the sling may be placed snugly about a variety of different sized work pieces; and more preferred to provide a sling wherein a second plurality of the plurality of eye-loops preferably have an effective distance within about one (~1") inch of the following values: nineteen and seven-eighths, twenty-six, thirty-two and three-fourths, thirty-nine, forty-two and seven-eighths, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eighths inches. Thus, the effective distance of each eye-loop of the second plurality preferably is different from the effective distance of every other eye-loop of the second plurality.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a plan or top view of a first, preferred, exemplary embodiment of the strap used in the sling system of the invention; while

FIG. 10 is a simplified representation of an exemplary method of laterally moving the heavy, pipe work piece of FIGS. 8 & 9, after the load has been hoisted using two of the alternative embodiment of the strap of FIG. 7 of the sling system of the invention; while

EXEMPLARY MODES FOR CARRYING OUT THE INVENTION

Figure 1:
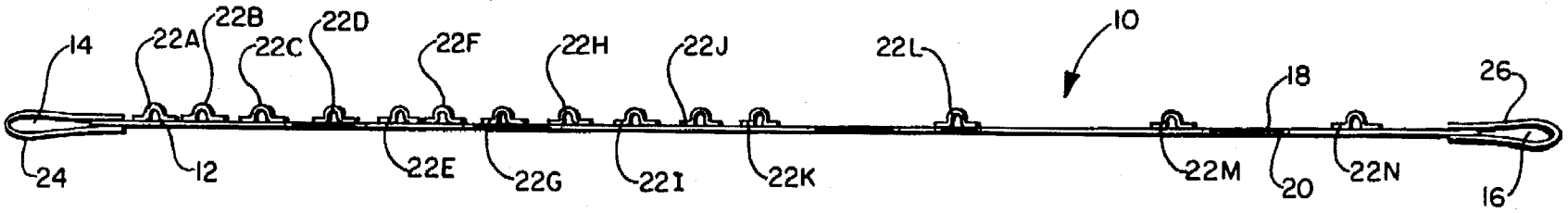

FIG. 1 is a side view of an exemplary embodiment of the sling 10 of the invention. The sling 10 comprises, for example, a two (2") inch wide, single, elongated, flat woven nylon strap 12 of about twelve (~12') feet in length, having a first strap end 14, a second co-extensive strap end 16, a first, outside strap surface 18, and a second, interior strap surface 20. The first strap surface 18 has a plurality of eye-loops 22A–22N stitched thereto and spaced along the length thereof in an in-line fashion, as can be seen in FIG. 2 (note also FIG. 7).

Each eye-loop 22A–22N is constructed from the same woven nylon material as the sling, which, as known to those of ordinary skill in the art, provides an in-elastic sling. Each of the eye-loops 22A–22E and 22G–22N is, for example, about four (~4") inches long in the direction of strap 12 and rises from the first strap surface 18 to an average height of, for example, about two (~2") inches. The eye-loop 22F is, for example, about three (~3") inches long in the direction of strap 12 and rises from the first strap surface 18 to an average height of, for example, about two (~2") inches.

Figure 2:
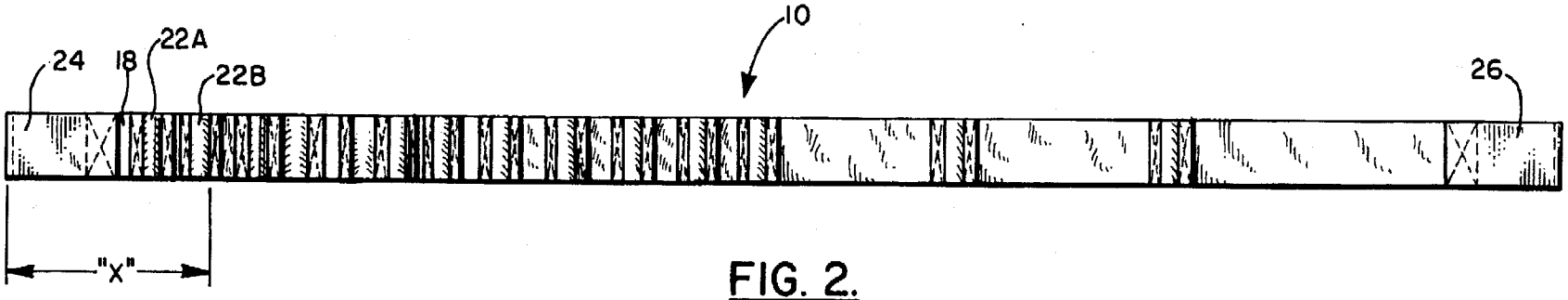
FIG. 2 is a side view of the preferred embodiment of the strap of FIG. 1.

The first strap end 14 terminates in a first-end loop 24, while the second strap end 16 terminates in a second end-loop 26 (more clearly shown in FIG. 2). Each of the end-loops 24, 26 is selectively attachable to one of the plurality of eye-loops 22A–22N in a manner to form a closed lifting loop.

Each eye-loop 22B–22N is separated from the first end-loop by a predetermined distance sufficient to allow the eye-loops 22B–22N to be used in conjunction with the first end-loop to form a snug fit about a different standard size pipe. In this exemplary embodiment, the eye-loops 22B–22N have the following effective distances:

22B-nineteen and seven-eighths (19⅞") inches;

22C-twenty-six (26") inches;

22D-thirty-two and three-fourths (32¾") inches;

22E-thirty-nine (39") inches;

22F-forty-two and seven-eights (42⅞") inches;

22G-forty-nine and one-fourth (49¼") inches;

22H-fifty-five and one-half (55½") inches;

22I-sixty-one and seven-eighths (61⅞") inches;

22J-sixty-eight (68") inches;

22K-seventy-four and three-eighths (74⅜") inches;

22L-ninety-three and one-fourth (93¼") inches;

22M-one-hundred-twelve (112") inches; and 22N-one-hundred-thirty and seven-eighths (130⅞") inches;

As described herein before, the term "effective distance" means the farthest distance between the point of connection on the first strap end and the farthest interior portion of an eye-loop. For example, the distance "X", shown in FIG. 2, visually illustrates the effective distance of eye-loop 22B.

Figure 4:
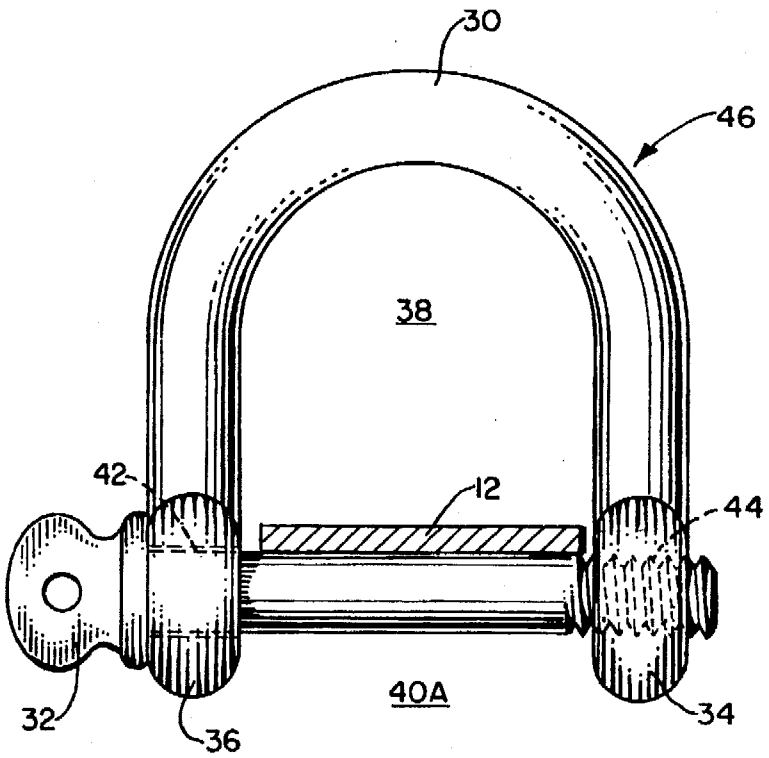
FIG. 4 is a side view of a second, more preferred shackle adapted for use with the strap embodiment of FIGS. 1 & 2.
Figure 3:
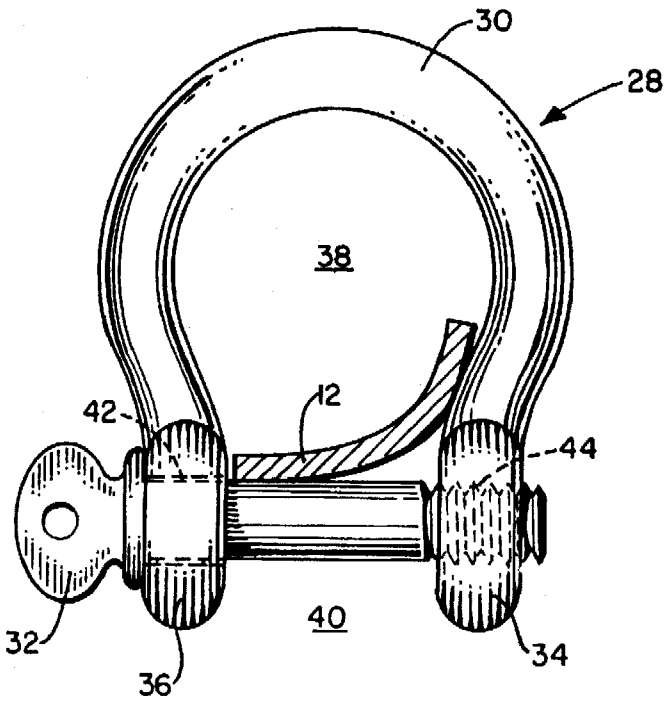
FIG. 3 is a side view of a typical shackle for use in lifting and hoisting operations in association with the strap embodiment of FIGS. 1 & 2.

FIGS. 3 and 4 show exemplary attachment devices for selectively attaching the first end-loop 24 to one of the plurality of eye-loops 22A–22N. The attachment device shown in FIG. 3 is a typical shackle 28. As shown, the typical shackle 28 includes a shackle bar 30 and a shackle pin 32. The shackle bar 30 has first and second shackle-end 34, 36, respectively, that has been bent to form a central opening 38 which is accessible through a throat opening 40. Each of the first and second shackle-ends 34, 36 has an aperture 42, 44, respectively, there through of a size sufficient to receive therein a portion of the shackle pin 32. The throat opening 40 of the typical shackle 28 is smaller than the width of the strap 12.

FIG. 4 shows a preferred shackle 46. The shackle 46 is constructed in the same manner as the typical shackle 28. However, it is noted that throat opening 40A of the preferred shackle 46 is larger than the width of the strap 12.

Figure 5:
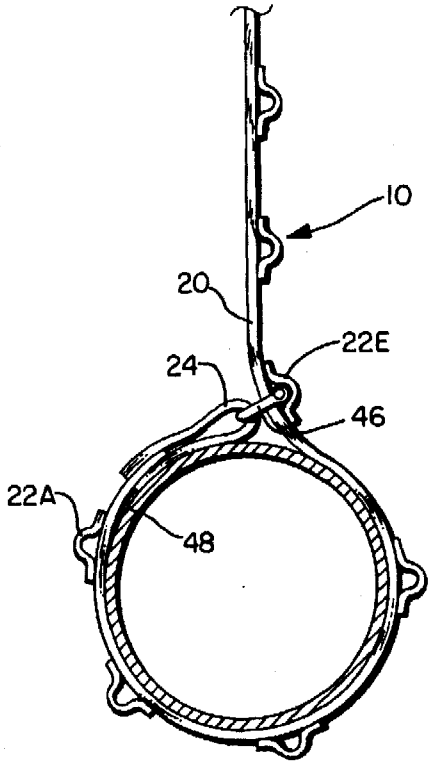
FIG. 5 is a simplified representation showing in an end view a preferred method of securing the strap sling about an exemplary pipe using the strap embodiment of FIGS. 1 & 2.

FIG. 5 shows a sling 10 in position about a pipe 48 having an external diameter of about twelve (~12") inches. Sling 10 is attached about pipe 48 by placing second strap surface 20 about the exterior circumference of pipe 48, placing shackle bar 30 through first end-loop 24 and eye-loop 22E, and inserting shackle pin 32 into apertures 42, 44.

Figure 6:
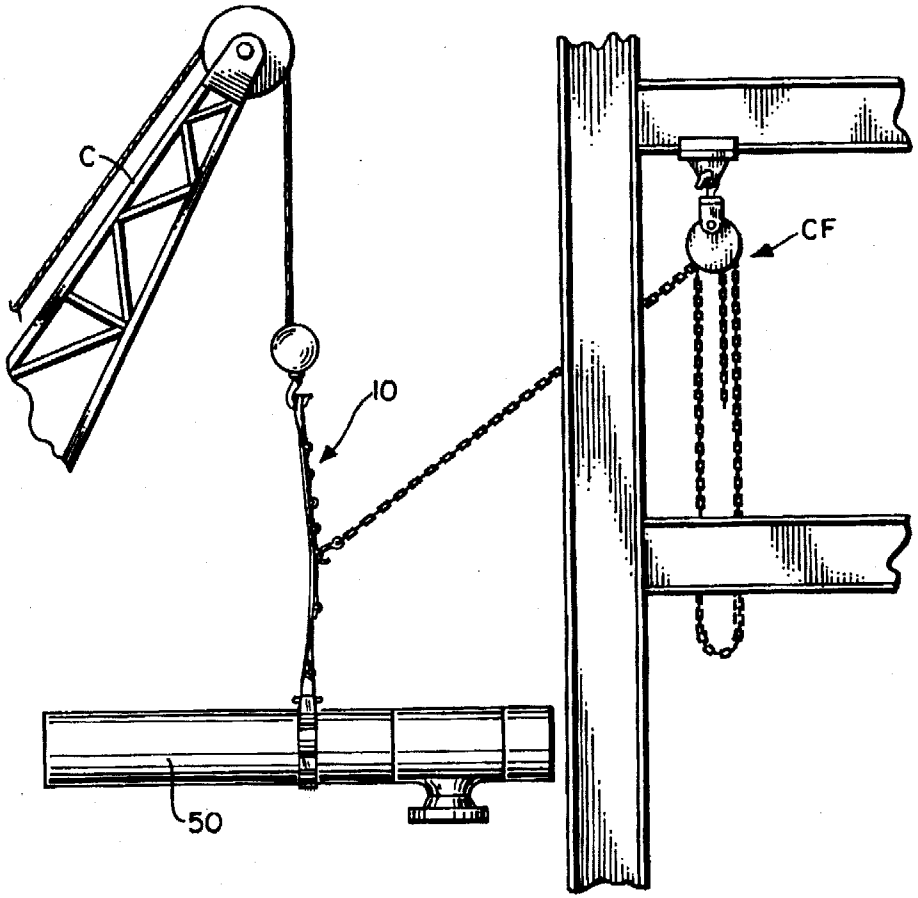
FIG. 6 is a further, simplified representation of a different, exemplary method of hoisting a heavy pipe as an exemplary work piece, using the strap embodiment of FIGS. 1 & 2.

FIG. 6 shows sling 10 in use lifting a heavy work piece 50, such as, for example, a pipe section. As shown in the figure, eye-loops 22A–22N may also be used as locations for one or more guide line attachments, as well as for passing the work piece along a series of block and tackle assemblies.

An exemplary method of lifting a work piece 50 is now described with general reference to FIGS. 1–6. The method comprises the following steps: (a) providing a sling 10, and a preferred shackle 46 (both as herein above described); (b) wrapping the first strap end 14 about the circumference of a work piece 50 in a manner such that the second strap surface 20 is in contact with work piece 50; (c) attaching first strap end 14 to one of eye-loops 22A–22N with preferred shackle 46; and (d) exerting a force on the sling 10 sufficient to lift work piece 50.

Figure 7:
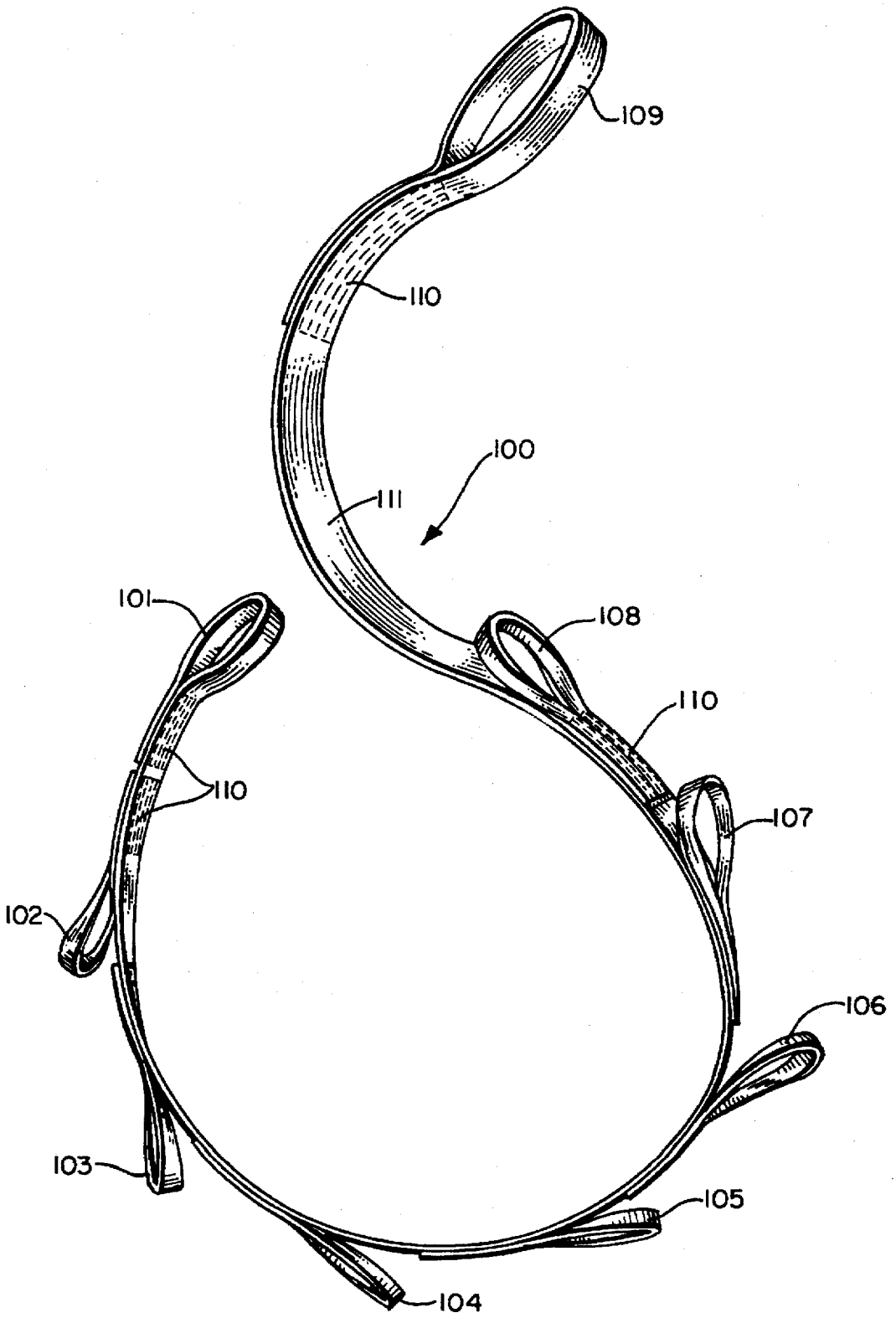
FIG. 7 is a perspective view of a further, simpler, alternative embodiment of the strap end used in the sling system of the invention.

An alternative, simpler embodiment for the sling system is illustrated in FIG. 7, in which the strap 100 includes a first end loop 101 and an opposite, second end loop 109, formed by looping the opposite ends of the strap material 111 back unto itself and stitching it at the two end, stitch sections 110.

The strap body 111 includes a series of seven, equally spaced eye-loops 102–108 along the length of the strap sling 100. Each of the eye-loops 102–108 is formed by a piece of fabric material (e.g. Nylon™) folded back on its ends, with the ends then fastened or connected to the strap body 111 by stitch sections 110, thereby producing closed loops to which shackles, hooks or other implements can be attached, in similar fashion to that dicussed with respect to the first embodiment FIGS. 1 & 2).

As can be seen in FIG. 7, the terminal ends of each of the eye-loops 102–108, which occupy the stitch sections 110, are disposed side-by-side along and parallel to each other and parallel to the direction of elongation of the strap 100; while, as can be seen in FIG. 1, the terminal ends are perpendicular to the direction of elongation of the strap 12. As can be further seen in FIG. 7, the first end loop 101 is integrally formed from said strap 100, with the terminal end of the strap material being looped back unto an adjacent part of the strap, with the terminal end and the adjacent part being fastened together forming the first end loop having a tip which is directed away from the rest of the strap, in contrast to the tips of the eye-loops 102–108 having tips directed away from the tip of the first end loop.

Figure 8:
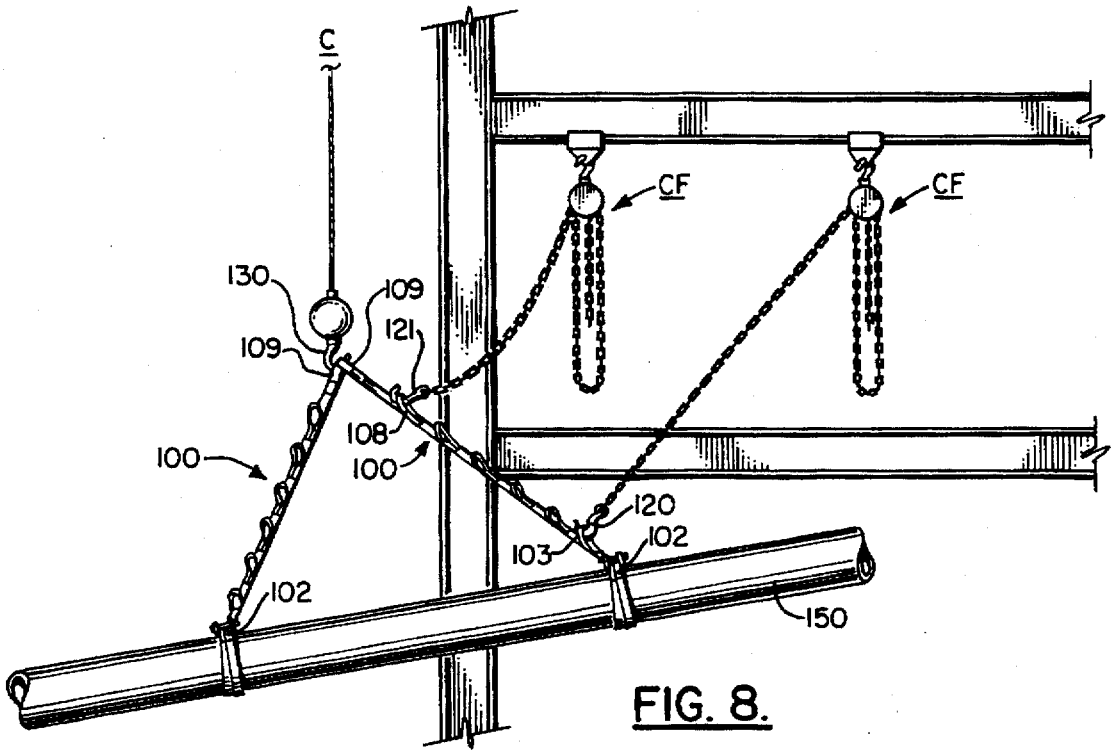
FIG. 8 is a simplified representation of another, exemplary method of hoisting a heavy, pipe work piece or load using two of the alternative embodiment of the strap of FIG. 7 of the sling system of the invention.
Figure 9:
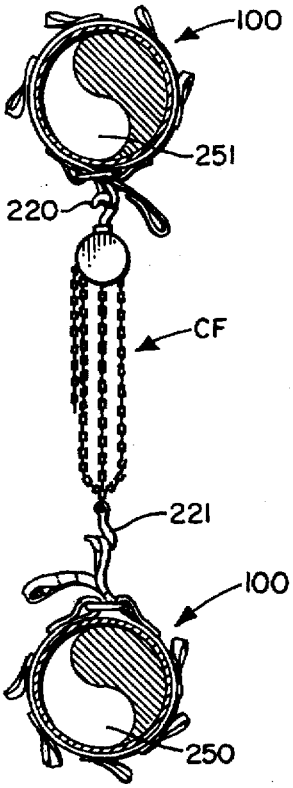
FIG. 9 is a simplified representation of still another, exemplary method of hoisting a heavy, pipe work piece or load using two of the alternative embodiment of the strap of FIG. 7 of the sling system of the invention.

FIGS. 8 & 9 illustrate exemplary uses of a set of two of the strap slings 100 of FIG. 7.

As can be seen, for example, in FIG. 8, for each sling strap 100 the first end loop 101 is connected to the appropriately spaced eye-loop (e.g. eye-loop 102) for the size of the pipe work piece 150 to snugly attach them to the pipe work piece. An exemplary pipe load, such as that illustrated, weighs, for example, hundreds of pounds.

Side chain hooks 120, 121 are attached to (i.e. hooked into) appropriately selected eye-loops (e.g. eye-loops 103 & 108) for appropriately manipulating the slings 100 and the pipe work piece 150. The crane hook 130 is hitched into the opposite, end loops 109 for supporting and moving the slung load 150.

As can be seen, for example, in FIG. 9, for each sling strap 100 the first end loop 101 is connected to the appropriately spaced eye-loop (e.g. eye-loop 108) for the size of the pipe work piece 250 to snugly attach them to the pipe work piece. Chain hooks 220, 221 are attached (i.e. hooked into) the opposite, end loops 109 for supporting one slung load 250 under the other slung load 251.

With respect to the arrangements illustrated in FIGS. 8 & 9, when using one or more of the slings 100 to catch and drift loads, the load is picked up typically with some type of crane C. The crane supported load (e.g. pipe 150) is swung as close to the structure as possible and the weight can be caught and the crane released by hooking the chain-fall CF into one of the added eyes.

Figure 10:
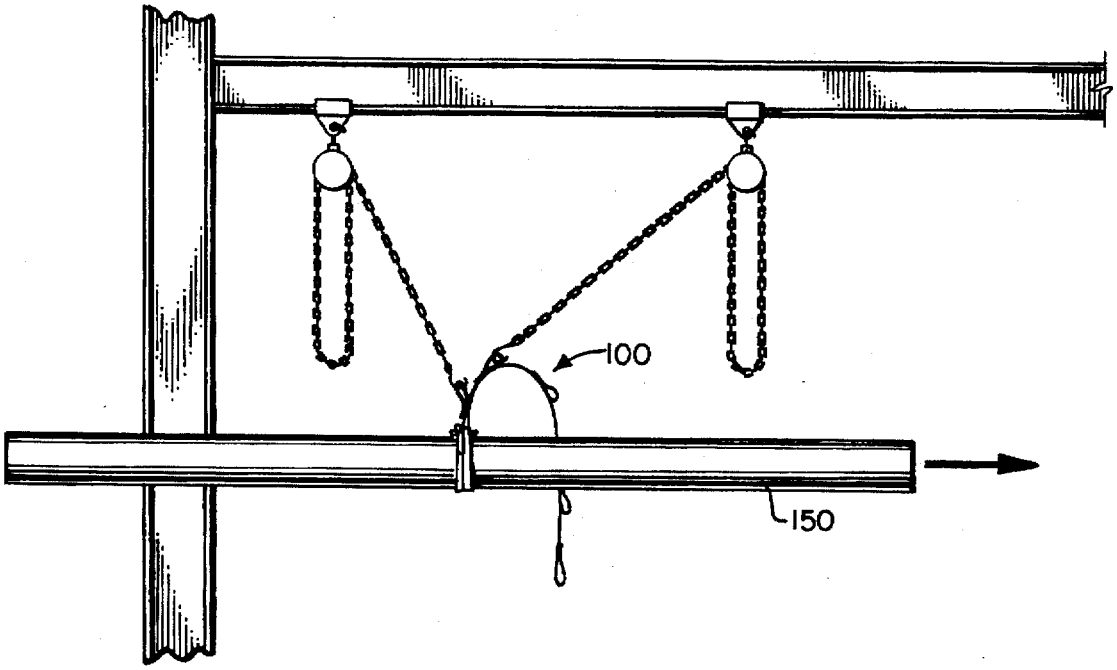
Figure 10A:
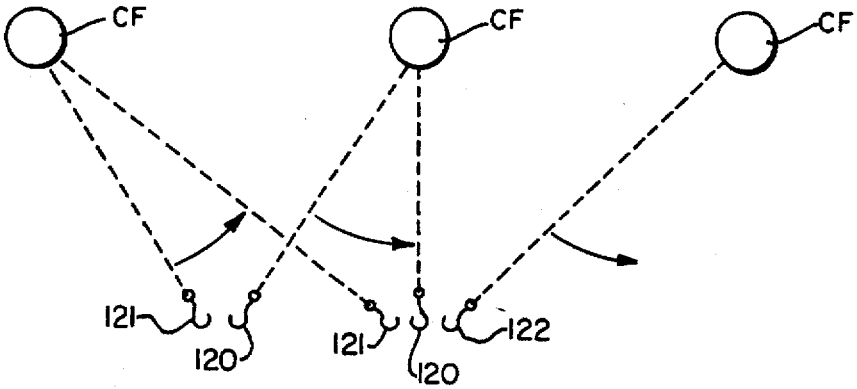
FIG. 10A is a simplified representation illustrating the use of a series of chain-falls to move the load along a supporting structure.

The arrangement of FIG. 8 shows two slings 100 being used, but normally one would use only one sling unless the load is long in length. By pulling with one chain-fall to the location needed, the second chain-fall will hold back, allowing the load to be controlled to a certain elevation and level and, also, this helps control the speed at which the load will move so there is no or at least diminished danger in damaging existing structures or materials. The number of chain-falls to be used will be determined by the distance the load has to travel, and the chain-falls are placed at different locations for the best routing of the load. The user moves the load from one chain-fall to the next one—until it has reached, for example, the point of installation, as generally illustrated in FIGS. 10 & 10A.

It is noted that the sling 100 of FIG. 7 is an actual test design made for easy manufacturing and strength, and represents the currently most preferred embodiment of the invention.

Of course the foregoing are merely exemplary of the many different ways the sling system of the present invention can be used in connection with heavy loads, such as, for example, heavy pipe sections, and the particular dimensions and sizes provided above are of course also very exemplary and subject to great variation.

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A sling capable of lifting a heavy load and moving the heavy load about in the air while supported by the sling, comprising:

a substantially in-elastic, elongated, single strap of flexible, fabric-like material having a first strap end, a second strap end, a first, flat, outer, strap surface, and a second, flat, inner, strap surface co-extensive with said outer, strap surface; said first strap surface having in connection therewith a plurality of in-line eye-loops of flexible, fabric-like material spaced in line along the length of said single, elongated strap, said first strap end being separately selectively attachable to each one of said plurality of eye-loops forming a closed, in-elastic lifting loop capable of looping about, holding and lifting various sized loads, with the effective diameter of said loop being variable to produce a loop having a comparable inner diameter in comparison to the outer periphery of the particular heavy load being lifted.

2. The sling of claim 1, further including:

an attachment means for selectively attaching said first strap end to one of said plurality of eye-loops, said attachment means having a first portion disposed through one of said plurality of eye-loops when said first strap end is attached to said one of said plurality of eye-loops.

3. The sling of claim 2, wherein:

said first strap end terminates in a first end-loop, and said attachment means further includes a second portion that is disposed through said first end-loop when said first strap end is attached to one of said plurality of eye-loops.

4. The sling of claim 1, wherein:

a number of said plurality of eye-loops are each spaced a different predetermined distance from said first strap end in a manner such that said sling may be placed snugly about a variety of different sized heavy loads when said first strap end is attached to said one of said plurality of eye-loops.

5. A sling capable of lifting a heavy load, comprising:

a strap of flexible, fabric-like material having a first strap end, a second strap end, a first strap surface, and a second strap surface; said first strap surface having in connection therewith a plurality of eye-loops of flexible, fabric-like material spaced along the length thereof, said first strap end being selectively attachable to one of said plurality of eye-loops forming a closed lifting loop;

a number of said plurality of eye-loops being each spaced a different predetermined distance from said strap end in a manner such that said sling may be placed snugly about a variety of different sized loads when said first strap end is attached to said one of said plurality of eye-loops; and a second plurality of said of eye-loops having an effective distance within about one (~1") inch of the following values: nineteen and seven-eighths, twenty-six, thirty-two and three-fourths, thirty-nine, forty-two and seven-eighths, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eighths; said effective distance of each eye-loop of said second plurality being different from said effective distance of every other eye-loop of said second plurality.

6. The sling of claim 5, further including:

an attachment means for selectively attaching said first strap end to one of said plurality of eye-loops, said attachment means having a first portion disposed through one of said plurality of eye-loops when said first strap end is attached to said one of said plurality of eye-loops.

7. The sling of claim 6, wherein:

said first strap end terminates in a first end-loop, and said attachment means further includes a second portion that is disposed through said first end-loop when said first strap end is attached to one of said eye-loops.

8. A sling capable of lifting a heavy load and moving the heavy load about in the air while supported by the sling, comprising:

a elongated, single strap of flexible, fabric-like material having a first strap end terminating in a first end-loop, a first, flat, outer, strap surface, and a second, inner strap surface; said first strap surface having in connection therewith a plurality of in-line eye-loops of flexible, fabric-like material spaced from on another in line along the length of said single, elongated strap, with each eye-loop having two, terminal ends both fastened to said outer strap surface forming its respective eye-loop, said first end-loop being separately selectively attachable to a selected one of said in-line eye-loops varying the effective diameter of said strap and allowing it to be used with different sized loads by attaching said first end-loop to the appropriately selected spaced eye-loop for the particular sized load.

9. The sling of claim 8, wherein:

a number of said eye-loops are each spaced a predetermined distance from said first end-loop in a manner such that the sling may be placed snugly about a variety of different sized heavy loads.

10. The sling of claim 9 wherein said first end-loop being separately selectively attachable to a selected one of said in-line eye-loops with a shackle, which shackle further comprises:

a shackle bar, having a first and second shackle-end, bent to form a central opening accessible through a throat opening; and a shackle pine, each of said first and second shackle-ends having an aperture there through of a size sufficient to receive therein a portion of said shackle pin, said throat opening being of a size sufficient to allow a section of said strap to pass there-through into said central opening.

11. The sling of claim 8, wherein:

said two terminal ends of each of said eye-loops are fastened to and along said outer strap surface substantially parallel to the other of said terminal ends.

12. The sling of claim 11, wherein:

said two terminal ends of each of said eye-loops extend substantially parallel to the direction of elongation of said strap.

13. The sling of claim 11, wherein:

said two terminal ends of each of said eye-loops extend substantially perpendicular to the direction of elongation of said strap.

14. The sling of claim 11, wherein:

each of said eye-loops is in connection with said first strap surface along a length of said first strap surface between about one and six (~1–6") inches long.

15. The sling of claim 8, wherein:

said two terminal ends of each of said eye-loops is fastened to said outer strap surface by stitching.

16. The sling of claim 8, wherein said strap has a first end, and wherein:

said first end loop is integrally formed from said strap, with said first end being looped back unto an adjacent part of said strap, with said end and said adjacent part being fastened together forming said first end loop and having a tip which is directed away from the rest of said strap.

17. The sling of claim 16, wherein:

said two terminal ends of each of said eye-loops are fastened along side of one another onto said outer strap surface forming its respective eye-loop with a tip directed away from the tip of said first end loop.

18. The sling of claim 17, wherein:

said first end is fastened to said adjacent part of said strap by stitching, and said two terminal ends of each of said eye-loops is fastened to said outer strap surface by stitching.

19. A sling for lifting a heavy load, comprising:

a strap of flexible, fabric-like material having a first strap end terminating in a first end-loop, a first strap surface, and a second strap surface; said first strap surface having in connection therewith a plurality of eye-loops of flexible, fabric-like material spaced along the length thereof, said first end-loop being attachable to one of said eye-loops with a shackle;

a number of said eye-loops being each spaced a predetermined distance from said first end-loop in a manner such that the sling may be placed snugly about a variety of different sized heavy loads;

a shackle including a shackle bar, having a first and second shackle-ends, formed with a central opening accessible through a throat opening; and a shackle pin, each of said first and second shackle-ends having an aperture there through of a size sufficient to receive therein a portion of said shackle pin, said throat opening being of a size sufficient to allow a section of said strap to pass there through into said central opening;

a number of said eye-loops being spaced a predetermined distance from said first strap end in a manner such that the sling may be placed snugly about a variety of heavy loads; and a second plurality of said plurality of eye-loops having an effective distance within about one (~1") inch of the following values: nineteen and seven-eights, twenty-six, thirty-two and three-fourths, thirty-nine, forty-two and seven-eighths, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eighths inches; said effective distance of each eye-loop of said second plurality being different from said effective distance of every other eye-loop of said second plurality.

20. The sling of claim 19 wherein:

each of said eye-loops is in connection with said first strap surface along a length of said first strap surface between about one and six (~1–6") inches long.

21. A method of lifting a heavy load, comprising the following steps:

a) providing a sling comprising a strap of flexible, fabric-like material having a first strap end, a second strap end, a first step surface, and a second strap surface; said first strap surface having in connection therewith a plurality of eye-loops of flexible , fabric-like material spaced along the length thereof; and an attachment means for selectively attaching said first strap end to one of said eye-loops, said attachment means having a first portion disposed through one of said eye-loops when said first strap end is attached to one of said eye-loops;

b) wrapping said first strap end about said load in a manner such that said second strap surface is in contact with the heavy load;

c) attaching said first strap end to a selected one of said eye-loops with said attachment means;

d) exerting a force on said strap sufficient to lift the heavy load;

said strap further including:

a number of said eye-loops each spaced a predetermined distance from said first strap end in a manner such that the sling may be placed snugly about a variety of different sized heavy loads;

and there is further included in the step "c" the step of:

selecting one of said eye-loops which produces a loop having a comparable inner diameter in comparison to the outer periphery of the heavy load being worked on.

22. The method of claim 21, wherein there is further included:

a second plurality of said plurality of eye-loops have an effective distance within one inch of the following values: nineteen and seven-eighths, twenty-six, thirty-two and three-fourths, thirty-nine, forty-two and seven-eighths, forty-nine and one-fourth, fifty-five and one-half, sixty-one and seven-eighths, sixty-eight, seventy-four and three-eighths, ninety-three and one-fourth, one-hundred-twelve, and one-hundred-thirty and seven-eighths inches; said effective distance of each eye-loop of said second plurality being different from said effective distance of every other eye-loop of said second plurality.

23. The method of claim 21, wherein:

said first strap end terminates in a first end-loop, and said attachment means further includes a second portion; and wherein there is further included the step of:

placing said second portion through said first end-loop when said first strap end is attached to one of said eye-loops.

24. The method of claim 23, wherein:

said attachment means is a shackle including a shackle bar, having first and second shackle-ends, configured to form a central opening accessible through a throat opening, and a shackle pin, each of said first and second shackle-ends having an aperture there through of a size sufficient to receive therein a portion of said shackle pin, said throat opening being of a size sufficient to allow a section of said strap to pass there through into said central opening;

and wherein said step of attaching said first strap end to one of said eye-loops includes the steps of:

i) placing said first end-loop about said shackle bar in a manner such that a portion of said first end-loop is disposed within said central opening;

ii) positioning one of said eye-loops in a manner such that an interior opening of said eye-loop is positioned between said apertures of said first and second shackle-ends of said shackle bar; and iii) inserting said shackle pin through said apertures of said first and second shackle-ends while said interior opening of said eye-loop is positioned there between.

25. The method of claim 24, wherein:

a number of said eye-loops are each spaced a predetermined distance from said first strap end; and there is included the further steps of:

placing the sling snugly about a variety of different sized heavy loads at different times.

26. A method of lifting a heavy load, comprising the following steps:

a) providing a sling comprising a strap of flexible, fabric-like material having a first strap end, a second strap end, a first strap surface, and a second strap surface; said first strap surface having in connection therewith a plurality of eye-loops of flexible, fabric-like material spaced along the length thereof; and an attachment means for selectively attaching said first strap end to one of said eye-loops, said attachment means having a first portion disposed through one of said eye-loops when said first strap end is attached to one of said eye-loops;

b) wrapping said first strap end about the heavy load in a manner such that said second strap surface is in contact with the heavy load;

c) attaching said first strap end to one of said eye-loops with said attachment means; and d) exerting a force on said strap sufficient to lift the heavy load;

there being further included a multiple number of supported chain-falls located in proximity to one another and at least two of said straps both located to opposite sides of a common chain connection to said slings;

and there is included the further step of:

e) drifting the heavy load from one chain-fall to an adjacent chain-fall using chain hooks carried by said chain-falls to be inserted into selected ones of said eye-loops of each strap.

27. A method of lifting two work pieces of significantly different diameters at different times using the same sling and a separate mechanical lift device, comprising the following steps:

a) providing a sling comprising a strap of substantially in-elastic, elongated, flexible, fabric-like material having a first strap end, a second strap end, a first, flat, outer, strap surface, and a second, flat, inner, strap surface; said first strap surface having in connection therewith a plurality of in-line eye-loops of flexible material spaced from one another along the length of said single, elongated strap; and an attachment means for selectively attaching said first strap end to a selected one of said eye-loops, said attachment means having a first portion disposed through one of said eye-loops when said first strap end is attached to one of said eye-loops;

b) wrapping said first strap end about said first work piece in a manner such that said second, inner strap surface is in face-to-face contact with said first work piece;

c) attaching said first strap end to a selected one of said eye-loops with said attachment means to accommodate and at least generally match the diameter of said first work piece;

d) using a first mechanical device to exert a lifting force on said strap sufficient to lift said first work piece;

e) releasing said first work piece from the strap and separating the two;

f) wrapping said first strap end about said second work piece in a manner such that said second, inner strap surface is in face-to-face contact with said second work piece;

g) attaching said first strap end to another selected one of said eye-loops with said attachment means to accommodate the different diameter of the second work piece, using a different eye-loop from the eye-loop used in step "c"; and h) using a mechanical device to exert a lifting force on said strap sufficient to lift said second work piece;

thereby using the same sling to wrap around the two different work pieces at different times and separately lift said different diameter work pieces.

28. The method of claim 27, comprising the further steps of:

using in the step "d" a separate, second mechanical lift device located to the side of said first mechanical lift device having a separate lift line attached to said sling at an eye-loop located above said selected one of said eye-loops; and moving said first work piece in a sideward direction using the attachment of said separate lift line from said second mechanical lift device to the eye-loop located above said selected one of said eye-loops to apply a sideward directed force to said sling.

* * * * *